United States Patent [19]

Mazurek

[11] 4,043,168

[45] Aug. 23, 1977

[54] SHELL CONTROL MANIFOLD

[75] Inventor: Stanley L. Mazurek, Chicago, Ill.

[73] Assignee: Continental Can Company, Inc., New York, N.Y.

[21] Appl. No.: 623,501

[22] Filed: Oct. 17, 1975

[51] Int. Cl.[2] ..... B21D 45/00

[52] U.S. Cl. ..... 72/345

[58] Field of Search ..... 72/344, 345, 328, 427; 113/7 R, 7 A, 120 H; 83/123, 152

[56] References Cited

U.S. PATENT DOCUMENTS

| | | | |
|---|---|---|---|
| 3,289,453 | 12/1966 | Wyle et al. | 113/120 H X |
| 3,654,796 | 4/1972 | Dunn | 72/345 |
| 3,881,380 | 5/1975 | Paramonoff | 83/152 |

*Primary Examiner*—Willie G. Abercrombie

*Attorney, Agent, or Firm*—Diller, Brown, Ramik & Wight

[57] ABSTRACT

This disclosure relates to a manifold for use in conjunction with a reciprocating die set for controlling air pressure within a sealed die which is closed by a formed shell so as to make certain that the shell remains with the sealed die as it is retracted relative to a die center, the manifold providing for a predetermined vacuum within the sealed die, which vacuum being sufficient to assure retraction of the formed shell with the sealed die but at the same time being maintained sufficiently low so as to prevent damage to the shell during the ejection thereof from the sealed die.

9 Claims, 2 Drawing Figures

SHELL CONTROL MANIFOLD

This invention relates to a manifold assembly for controlling air pressure within a sealed die closed by a formed article so as to maintain control over the article with respect to the sealed die while at the same time maintaining the vacuum sufficiently low to prevent damage to the article when it is ejected from the sealed die.

This invention is particularly related to the formation, by means of a double die punch, a shell for a can end, but is not so limited. A shell dropping problem has persisted over the years on many standard double dies producing shallow end units with or without shallow reverse center panels. The magnitude of the shell dropping problem has increase significantly due to the unique geometry of a shell which it is now desired to be produced, the shell having a reverse center panel which is approximately the same depth as the unit depth. This unique geometry of the shell has created a marginal condition wherein frequently a shell will drop out of the punch bore almost immediately after the punch withdraws from the cut edge after forming a shell. The dropped shell is not ejected properly by the ejector mechanism and gravity does not remove it rapidly enough. Consequently, it is chopped in the next stroke of the press.

In accordance with this invention, a shell control manifold was provided to retain the shell in the punch bore by controlling both the exhaust and intake air within the sealed punch cavity behind the formed shell. The control manifold includes a hose connected to each sealed pocket cavity. Associated with the hose are two check valves. One valve permits exhaust flow only. The other valve permits intake flow only with there being intake flow only after a predetermined vacuum has been reached in the punch cavity.

In accordance with this invention, when a shell is being formed, air is compressed within the punch and this air is permitted to escape through the first valve. Thus, a pressure build up within the sealed punch is prevented.

After the shell has been formed and the punch reverses its direction, there is a tendency for the shell not to be retracted with the punch and as a result, a vacuum is formed in the punch cavity. After the vacuum reaches a predetermined negative pressure, the second valve opens to permit air to flow into the punch cavity thus maintaining the vacuum at a predetermined level. This level is sufficient for the shell to be retained with the retracting punch and at the same time is not sufficiently great to cause damage to the shell when the shell is being ejected from the punch.

With the above and other objects in view that will hereinafter appear, the nature of the invention will be more clearly understood by reference to the following detailed description, the appended claims and the several views illustrated in the accompanying drawings:

Figure 1:
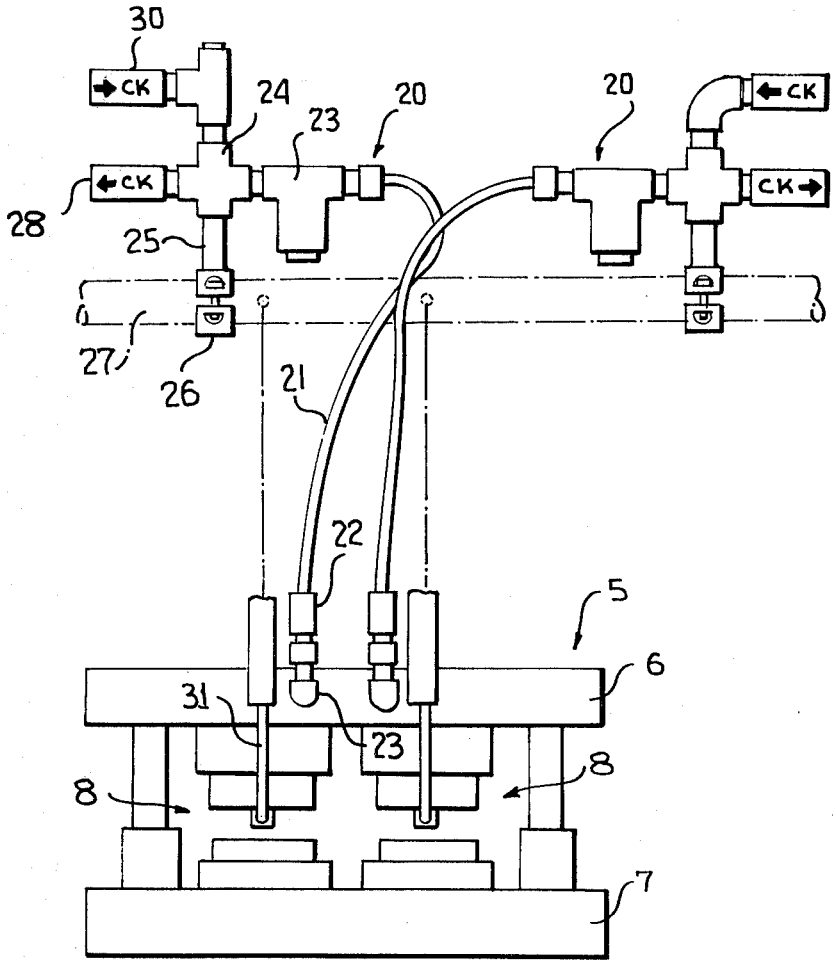
FIG. 1 is a schematic view showing a press assembly having two die sets therein, there being associated with each of the die sets a shell control manifold.

Referring now to the drawings in detail, it will be seen that there is illustrated in FIG. 1 a press unit generally identified by the numeral 5. The press unit 5 includes an upper platen 6 and a lower platen 7. Carried by the platens 6 and 7 are two, multi-piece die assemblies 8. The die assemblies 8 are of conventional construction and the specific details thereof are not disclosed here.

Figure 2:
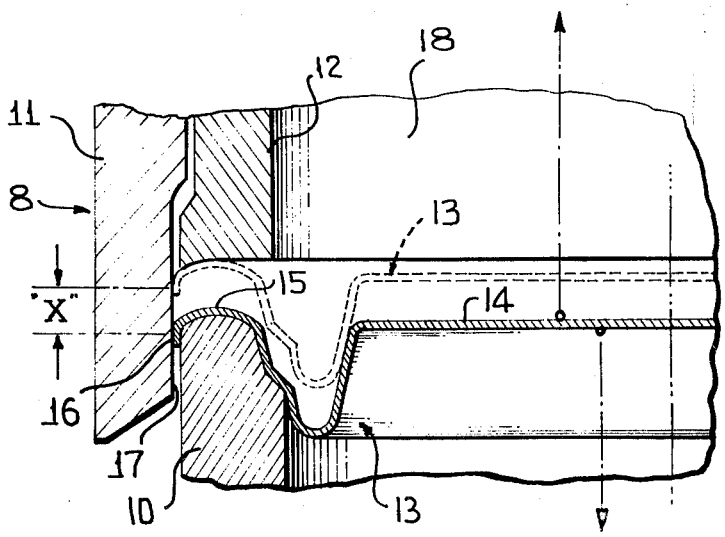
FIG. 2 is an enlarged fragmentary sectional view taken through one of the die sets in the vicinity of the shell and specifically shows the relationship of the shell with respect to the punch, a die center, and a knockout ring.

Referring now to FIG. 2, it will be seen that each die assembly 8 includes a die center 10, which is carried by the platen 7, and a punch 11 and a knockout ring 12, which are carried by the platen 6. In FIG. 2 there is also illustrated a shell, generally identified by the numeral 13 which is being formed by the die assembly 8. The shell 13 is in the form of an end unit for a container and includes a reversed center panel 14 which is offset from its initial position a distance substantially equal to the original depth of the shell. A peripheral portion 15 of the shell seats on the die center 10 while a peripheral edge 16 of the shell 13 is frictionally engaged in substantially sealing engagement with an inner surface 17 of the punch 11.

It is to be understood that the punch 11 is generally cup shaped and has a cavity 18 therein in which the knockout ring is positioned. The peripheral edge 16 of the shell closes the cavity 18 so that relative movement between the punch 11 and the shell 13 will result in varying the air pressure within the cavity 18.

It is to be understood that when the punch 11 moves downwardly, the shell 13 becomes seated on the die center 10 with the result that further downward movement of the punch 11 results in movement of the shell 13 into the cavity 18, tending to compress air within the cavity 18. After the punch passes through Bottom Dead Center (BDC), the shell has a tendency to stick to the die center and not move upwardly with the punch. This hesitation of movement of the shell is illustrated in FIG. 2 by the phantom showing of the shell and the distance of relative movement between the shell and the punch is generally indicated by the letter "X". As a result, a vacuum is drawn in the cavity 18.

In accordance with this invention, each die set is provided with a shell control manifold assembly, generally identified by the numeral 20. The assembly 20 includes a hose 21 which has a quick disconnect 22 from a fitting 22 carried by the platen 6 and leading into the respective punch cavity 18. The opposite end of the hose 21 is connected to a filter 23 which, in turn, is connected to a cross fitting 24. The cross fitting 24 attaches to a supporting leg 25 which carries a clamp 26 which is engageable with a support 27 to position the cross fitting 24. A third branch of the cross fitting 24 has connected thereto a check valve 28 while the fourth branch of the cross fitting 24 has connected thereto a check valve 30.

The check valve 28 is of a conventional construction and functions to prevent inflow of air while opening at a very low positive pressure. On the other hand, the check valve 30, which is also of conventional construction, prevents the exit of air and opens to vent an associated cavity only after a predetermined vacuum has been drawn in that cavity.

It is to be understood that the support 27 may be in the form of a kicker shaft which carries at least a kicker 31 for the die assembly 8 with which the shell control manifold 20 is associated. The kicker 31 ejects the formed shell from the punch 11 after it has withdrawn a certain distance. The function of the kicker 31 is conventional and thus will not be described further.

It is to be understood that in accordance with this invention, the punch 11 is cup shaped so as to define a cavity 18 which is sealed when a shell 13 is formed in the punch 11 in the manner illustrated in FIG. 2. As the punch 11 moves downwardly and the shell is seated on the die center ring, further downward movement of the punch 11 results in the relative movement of the shell 13 into the punch with the result that air within the cavity 18 is compressed. When the pressure of the air within the cavity 18 exceeds that from which the check valve 28 is set, this air will be rapidly exhausted to the atmosphere.

As the punch moves upwardly and the shell sticks on the die center 10, the relative movement between the punch 11 and the shell 13 results in a vacuum being formed within the cavity 18 so that when the shell 13 clears the die center 10, it is held to the punch 11 by the vacuum produced within the cavity 18.

At this time it is pointed out that it is desirable to restrict the holding power of the vacuum within the cavity 18 with respect to the shell so that the shell will not be damaged when it is ejected from the punch. Accordingly, after the vacuum within the cavity 18 reaches a predetermined negative pressure, the check valve 30 will open so as to vent the cavity 18 and to hold the vacuum therein at the preselected pressure.

When the punch approaches its Top Dead Center (TDC), the shell is knocked out of the punch by the knockout ring 12 and the kicker 31 kicks the shell out from between the punch parts.

It is to be understood that by limiting the vacuum within the cavity 18, the action of the ejector components on the shell will not deform the shell.

While the pressures of operation of the check valves 30 may vary, it is pointed out that the momentary hesitation of the shell on the die center for the distance "X" in FIG. 2 results in an increase of the volume of the cavity 18 behind the shell 13 sufficiently to cause the pressure to drop below 0.33 psig. Should the resultant pressure become a vacuum in excess of 4 inches HG, the valve 30 will open. It is also pointed out that a rapid increase in vacuum will also occur when the shell 13 is being knocked out of the punch 11 by the knockout ring 12 at TDC and by limiting the opening of the check valve 30 to a maximum vacuum of 4 inches HG, shell deformation is prevented.

Production of shells 13 of the type illustrated in FIG. 2, prior to this invention, was previously run on a conventional press at a speed of approximately 240 strokes per minute, below the normal operating speed of the press per se. This reduced speed was required to minimize shell dropping. With the shell control manifold incorporated in the press, the press operates satisfactorily at 340 strokes per minute. It will thus be apparent that the shell control manifold permits an increase in production in excess of 40%.

Although only a preferred embodiment of the shell control manifold assembly has been specifically illustrated and described herein, it is to be understood that minor variations may be made therein without departing from the spirit and scope of the invention, as defined by the appended claims.

What I claim is:

1. For use in combination with a reciprocating die set, apparatus for holding a formed article relative to the die set against permature release, said apparatus comprising a manifold assembly for controlling air pressure within a sealed die of said die set closed by a formed article, said manifold assembly comprising an air line, means for coupling said air line in communication with the interior of a sealed die, and check valve means coupled to said air line for controlling the exhaust and intake of air, said check valve means including a first check valve permitting exhausting of air while preventing intaking of air and a second check valve for preventing exhausting while permitting limited intaking of air, said check valve means being cooperable to produce a limited vacuum with said sealed die after the forming of an article to retain a formed article thereon while preventing article damage due to a too great vacuum resistance to removal of a formed article from said die, and article removal means of a positive type cooperable with the movement of said die for removing a vacuum held formed article from said die.

2. The assembly of claim 1 wherein said second check valve means is set to open for the intaking for air at a preset vacuum.

3. For use in combination with a reciprocating die set, apparatus for holding a formed article relative to the die set against premature release said apparatus comprising a manifold assembly for controlling air pressure within a sealed die of said die set closed by a formed article, said manifold assembly comprising an air line, means for coupling said air line in communication with the interior of a sealed die, and check valve means coupled to said air line for controlling the exhaust and intake of air, said check valve means including a first check valve permitting exhausting of air while preventing intaking of air and a second check valve for preventing exhausting while permitting limited intaking of air, said check valve means being cooperable to produce a limited vacuum within said sealed die after the forming of an article to retain a formed article thereon while preventing article damage due to a too great vacuum resistance to removal of a formed article from said die, said sealed die being in the form of a cup shaped punch closable by an article being formed and there being a die center ring adapted to be used in cooperation with said punch, and the relationship of said punch and said die center ring being one wherein an article punched by said punch has a tendency to momentarily stick to said die center ring during initial return stroke of said punch and then prematurely drop from said punch.

4. The apparatus of claim 3 together with formed article removal means of a positive mechanical type cooperable with the movement of said punch to remove a formed article therefrom.

5. The apparatus of claim 1 wherein said sealed die is in the form of a tubular punch of the type for receiving a formed article therein in friction holding relation.

6. The apparatus of claim 1 wherein said sealed die is in the form of a tubular punch of the type for receiving a formed article therein in friction holding relation, and there are mechanical ejector means within said punch for engaging an article formed by said punch and positively removing a formed article from said punch.

7. The apparatus of claim 6 wherein there is a die center ring cooperable with said punch in the formation of an article, and the relative configurations of said die center ring and a formed article is such that a frictional interlock being a formed article and said die center ring exceeding the friction holding of a formed article within said punch may at least temporarily exist.

8. A method of retaining a shell in a punch comprising the steps of providing a movable punch having a shell receiving cavity, utilizing said punch to form a shell with the shell sealing said cavity, moving said punch relative to a newly formed shell to pressurize air within said cavity while venting compressed air from said cavity, and then moving said punch relative to the shell to form a vacuum within said punch cavity, and restricting the vacuum to a predetermined value by venting said cavity after said predetermined vacuum is formed in said cavity to thereby provide for a limited vacuum holding of the shell relative to said punch, and mechanically removing the vacuum held shell from said punch.

9. The method of claim 8 together with the further step of forcibly ejecting a shell from said punch against the resistance of the limited vacuum holding.

* * * * *